United States Patent [19]

Gertsch

[11] 4,160,556

[45] Jul. 10, 1979

[54] HEEL OR SOLE HOLDER FOR A SOLE PLATE OF A SAFETY SKI BINDING AND SOLE PLATE EQUIPPED WITH SUCH HOLDER

[75] Inventor: Ulrich Gertsch, Matten, Switzerland

[73] Assignee: E. & U. Gertsch AG, Interlaken, Switzerland

[21] Appl. No.: 768,491

[22] Filed: Feb. 14, 1977

[30] Foreign Application Priority Data

Feb. 23, 1976 [CH] Switzerland ..... 2153/76

[51] Int. Cl.[2] ..... A63C 9/08

[52] U.S. Cl. ..... 280/618; 280/623; 280/633; 280/636

[58] Field of Search ..... 280/618, 617, 623, 626, 280/628, 634, 633, 627, 611, 620, 613

[56] References Cited

U.S. PATENT DOCUMENTS

| | | | |
|---|---|---|---|
| 2,610,861 | 9/1952 | Campbell | 280/627 |
| 2,788,981 | 4/1957 | Emerson | 280/623 |
| 2,793,869 | 5/1957 | Braun | 280/623 |
| 3,095,210 | 6/1963 | Hallam | 280/623 |
| 3,489,424 | 1/1970 | Gertsch et al. | 280/618 |
| 3,876,218 | 4/1975 | Von Besser | 280/618 |
| 3,900,205 | 8/1975 | Sittmann | 280/618 |
| 4,013,304 | 3/1977 | Begey et al. | 280/618 |

*Primary Examiner*—Joseph F. Peters, Jr.
*Assistant Examiner*—Milton L. Smith
*Attorney, Agent, or Firm*—Werner W. Kleeman

[57] ABSTRACT

A heel- or sole holder arranged at a sole or release plate of a ski binding, comprising a heel holddown guided in a guide means to be movable essentially parallel to the plane of the plate. The heel holddown can be rearwardly displaced out of an operating position which it has assumed under the action of spring force, against such spring force. The heel holddown possesses at one end a deflection or diverting surface which, in the operating position of the heel holddown, overlaps or extends over the ski boot-support surface of the sole or release plate and extends in the direction of the spring force towards the sole or release plate. The guide means is structured to slope or descend towards the sole or release plate in the direction of the spring force.

Further, the sole or release plate equipped with such heel holder has the latter connected with the sole or release plate by means of anchoring elements, for instance anchoring pins, engaging into transverse bores of the plate and secured in the axial direction thereof.

32 Claims, 7 Drawing Figures

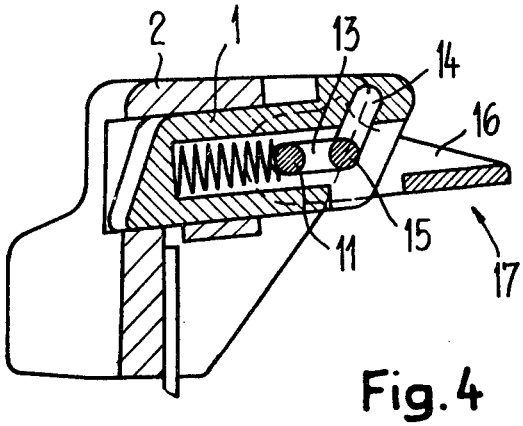
Fig. 4
Fig. 3
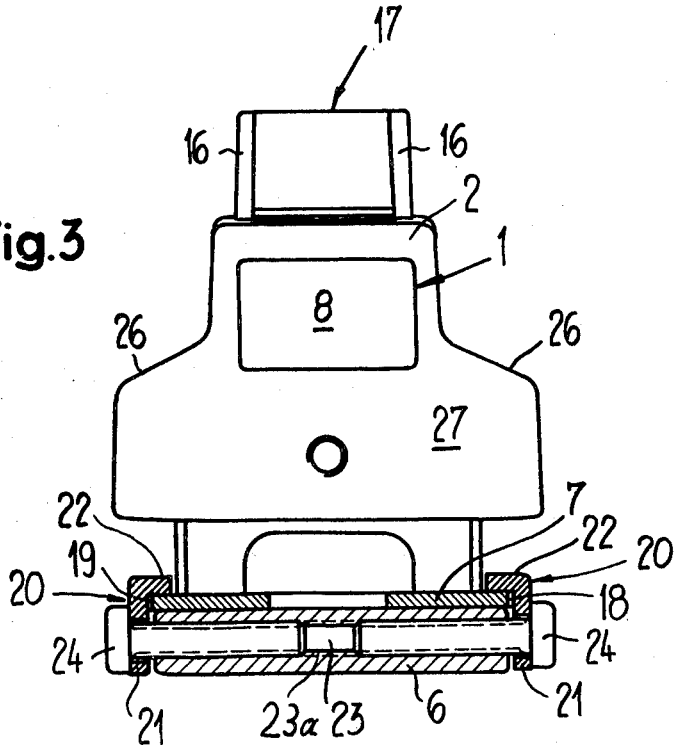

HEEL OR SOLE HOLDER FOR A SOLE PLATE OF A SAFETY SKI BINDING AND SOLE PLATE EQUIPPED WITH SUCH HOLDER

BACKGROUND OF THE INVENTION

The present invention broadly relates to the art of safety ski bindings, and, in particular, concerns a new and improved construction of a heel- or sole holder for a sole or release plate of a ski binding.

SUMMARY OF THE INVENTION

It is a primary object of the present invention to provide an improved construction of heel- or sole holder for a sole or release plate of a safety ski binding which is relatively simple in construction and design, economical to manufacture, extremely reliable in operation, and easy to use.

Another and more specific object of the present invention relates to the provision of a heel- or sole holder for effectively urging and maintaining in contact the heel and/or sole portion of a ski boot with a plate, typically the sole or release plate of a safety ski binding.

Now in order to implement these and still further objects of the invention, which will become more readily apparent as the description proceeds, the holder of the present invention is manifested by the features that a heel holddown is guided in a guide means to be movable substantially parallel to the plane containing the plate. The heel holddown can be displaced out of an operating position which it has assumed under the action of resilient or spring biasing means, against the spring force, and possesses a deflection or diverting surface which, in the operating position of the heel holddown, engages over the ski boot-support surface of the sole or release plate and extends towards such sole or release plate in the direction of the spring force. The heel holddown is guided in the guide means and the latter is structured to slope in the direction of the spring force towards the sole or release plate.

A further facet of the invention concerns a sole or release plate provided with such type heel- or sole holder for a safety ski binding, wherein the plate is provided with lateral transversely extending bores for anchoring the holder. According to the invention, the heel holddown is connected with the sole or release plate by means of anchoring elements, especially anchoring pins engaging into the transverse bores and secured in the axial direction thereof.

BRIEF DESCRIPTION OF THE DRAWINGS

The invention will be better understood and objects other than those set forth above, will become apparent when consideration is given to the following detailed description thereof. Such description makes reference to the annexed drawings wherein:

FIG. 3 is a cross-sectional view of the arrangement shown in FIG. 2, taken substantially along the line III—III thereof;

FIG. 4 illustrates in sectional view a detail of the holder of FIG. 1, showing the heel holddown in retracted position;

DETAILED DESCRIPTION OF THE PREFERRED EMBODIMENTS

Figure 1:
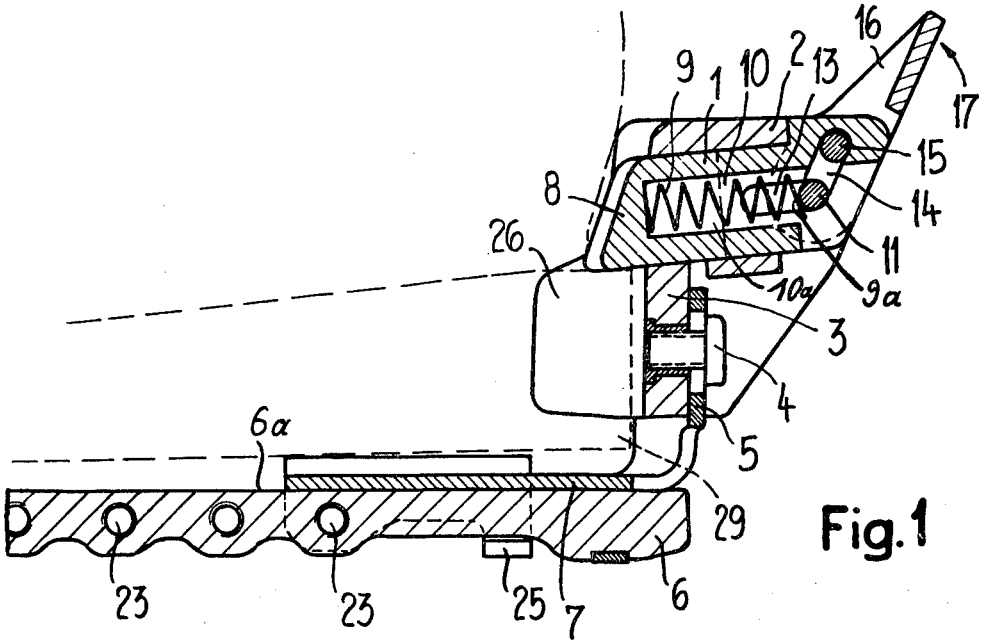
FIG. 1 illustrates the rear end of a sole or release plate equipped with a heel- or sole holder according to a first exemplary embodiment of the invention, shown in longitudinal sectional view taken substantially along the line I—I of FIG. 2.
Figure 2:
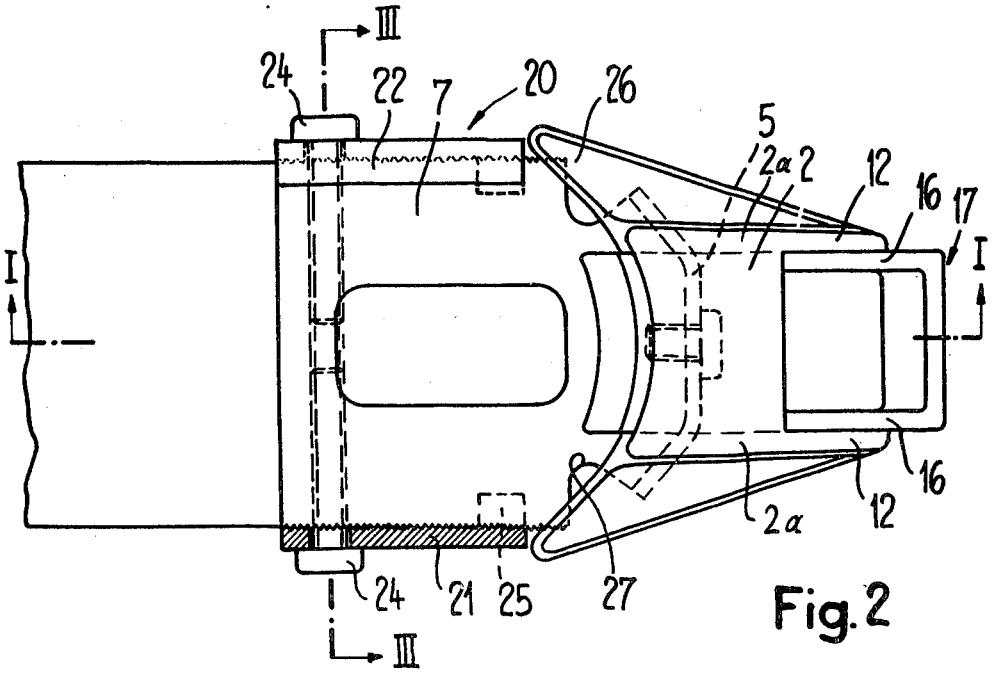
FIG. 2 is a top plan view of the holder and sole or release plate shown in FIG. 1.

Describing now the drawings, the heel- or sole holder—hereinafter simply referred to as a heel holder—shown by way of example in FIGS. 1–4, will be seen to comprise a holddown or holddown member 1, hereinafter referred to as a heel holddown, in the form of a block having a substantially rectangular cross-sectional configuration, preferably formed of a conventional plastic used in the ski binding art and having a low coefficient of friction. The heel holddown 1 is displaceably guided in a guide or guide means 2. This guide or guide means 2 is secured to be elevationally adjustable by means of a substantially flap-shaped projection or extension 3 and a clamping screw 4 or equivalent structure to an upwardly angled web or leg 5 of a flange 7 supported at a sole or release plate 6. The connection of the flange 7 with the release plate 6 will be described more fully hereinafter.

The heel holddown 1 will be seen to comprise a substantially wedge-shaped forward portion including a deflection or diverting surface 8 arranged at one end thereof, here its front or forward end which, in the operating position of the heel holddown 1 shown in FIG. 1, extends or engages over the ski boot-support surface 6*a* of the sole or release plate 6 and is directed forwardly towards such plate. In this operating position the heel holddown 1 is biased by a spring 9 or equivalent structure which is arranged in a recess 10 of the heel holddown 1 constructed as a blindhole bore 10*a*. The free end 9*a* of this spring 9 bears against a pivot pin or journal 11. This pivot pin or journal 11 engages at its opposed ends into the cheeks or side plates 12 which form extensions of the side walls 2*a* of the guide or guide means 2. At the region of the pivot pin 11 there are formed grooves 13 (see FIG. 4) in the side walls unnumbered of the heel holddown 1 which delimit or bound the recess 10, so that the pivot pin 11 does not obstruct displacement of the heel holddown 1 against the spring force, when it moves between the respective positions shown in FIGS. 1 and 4.

A further feature of the heel holddown 1 is that it is provided with a slot 14 or equivalent structure which is directed at an angle to the direction of the spring force and receives a movable pivot pin 15. This pivot pin 15 is anchored at its opposed ends in the side or lateral surfaces 16 of a substantially fork-shaped or bifurcated actuation lever 17. These side surfaces 16 laterally bear against the heel holddown 1, and they are located between the cheeks or side plates 12 (see FIG. 2) and connected therewith by means of the pivot pin 11. By virtue of these measures the heel holddown 1 can be displaced or rearwardly shifted by rocking the actuation lever 17—according to the showing of the FIGS. 1 and 4—in the clockwise direction out of its operating position shown in FIG. 1. The arrangement is accomplished such that the lever 17 can be brought into an unstable equilibrium position with respect to the spring force, in other words, into a position where both of the pivot pins 11 and 15 are located along the line of action of the spring force. In this position of the actuation lever 17 the heel holddown 1 is also blocked in its retracted position. If the actuation lever 17 is rocked back to a lesser extent, then upon release of such actuation lever the heel holddown 1 returns back into its operating position. Of course, the same holds true when the actuation lever 17 is rocked back to a slight degree out of its unstable equilibrium position according to FIG. 4. Naturally the lever 17 could be rocked slightly past the unstable equilibrium position. The purpose of such feature will be described more fully hereinafter.

The flange 7 possesses at both of its narrow sides an arrangement of fine teeth or serrations 18 which mesh with complementary teeth 19 of an associated angled or flexed attachment plate 20. These attachment plates 20 bear by means of their one flange 21 on the one or the other narrow side of the sole or release plate 6 and by means of their other respective flange 22 engage with the neighboring side of the flange or flange member 7. The sole or release plate 6 furthermore will be seen to be provided at its narrow sides with transversely extending or transverse bores or holes 23 equipped with threads, generally indicated by reference character 23*a*. The attachment plates 20 are connected by means of screws 24 or equivalent structure with the sole or release plate 6, which thus selectively engage with one of the transverse bores 23, depending upon the size of the ski boot. At their rear ends these attachment plates 20 are equipped with flaps or tabs 25 which engage below the sole or release plate 6. Due to these measures the flange 7 and therefore the heel holddown 1 can be exactly adjusted in the lengthwise direction of the sole or release plate 6 to the relevant size of the ski boot with which the heel holder is used. In order to support the heel 29 of the ski boot towards the rear and at both sides, the flap or flap member 3 possesses lateral projections or extensions 26 which collectively form together with the flap 3 a concave support or contact surface 27, as best seen by referring to FIG. 3. The ski boot is snugly held between this contact or support surface 27 and the sole holder (not shown) arranged at the front end of the sole or release plate 6. Lifting of the heel 29 upwardly is prevented by the holddown action of the heel holddown 1. In this connection it is important, as illustrated, that the guide means 2 is structured so as to slightly slope or extend downwardly in the direction of the spring force towards the sole or release plate 6. In this way it is especially possible to compensate for any existing deviations, brought about by manufacturing inaccuracies or due to wear or changing conditions which may be encountered (e.g. snow sticking to the bottom of the heel 29 or the like). With this arrangement retention of the ski boot heel and/or the sole against the sole or release plate in a manner free of play is not dependent upon any overly precise elevational adjustment of the heel holddown. Quite to the contrary, the heel holddown can in fact be arranged at a slightly excess height, thereby facilitating the insertion of the boot at all times, i.e., even when snow undesirably sticks to the ski boot. Also, manufacturing tolerances or wear is compensated. Finally, the freedom from play is also ensured if, for instance, the snow which has adhered to the ski boot when inserting the same into the ski binding has subsequently melted during skiing.

The described heel holder renders it possible to step into the binding without requiring any manual manipulations, since under the pressure of the heel against the deflection surface 8 the heel holddown 1 is temporarily pushed back out of its operating position. With proper elevational adjustment, and as soon as the heel 29 of the ski boot comes to rest against the ski boot-support surface 6*a* of the binding, the heel holddown 1 snaps back into its operating position, and especially by virtue of the inclined positioning of the guide means 2 the heel 29 of the boot is held snugly against the ski. In order to climb out of the binding the lever 17 must be rocked to such an extent that the heel holddown 1 releases the heel 29. As a general rule this occurs before the lever 17 has reached its unstable equilibrium position. This position is then also essentially provided in order to be able to climb into the open heel holddown under extreme conditions, for instance, in deep snow or on a steep slope, which heel holddown then can be manually closed. The blocking of the heel holddown 1 also is advantageous when the binding is fitted to the ski boot.

As should be readily apparent from the foregoing discussion, for fitting the binding there is assumed a base position in that the screws 24, depending upon the size of the boot, are inserted into one or the other of the transverse bores or holes 23. For adjustment purposes the flange 7 is shifted until the contact or support surface 27 bears against the heel 29. By tightening the screws 24 the flange 7 is then fixedly retained in this position. Due to these measures the described heel holddown also can be subsequently mounted on release or sole plates which have come into widespread use, and which possess such transverse bores or holes for the heretofore conventionally used holddown bracket.

Figure 6:
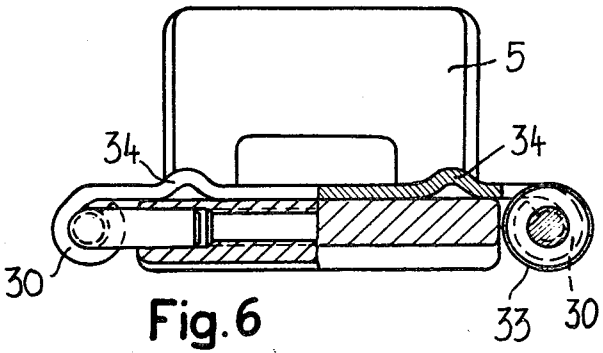
FIG. 6 is a cross-sectional view of the modified arrangement of FIG. 5, taken substantially along the line VI—VI thereof.
Figure 5:
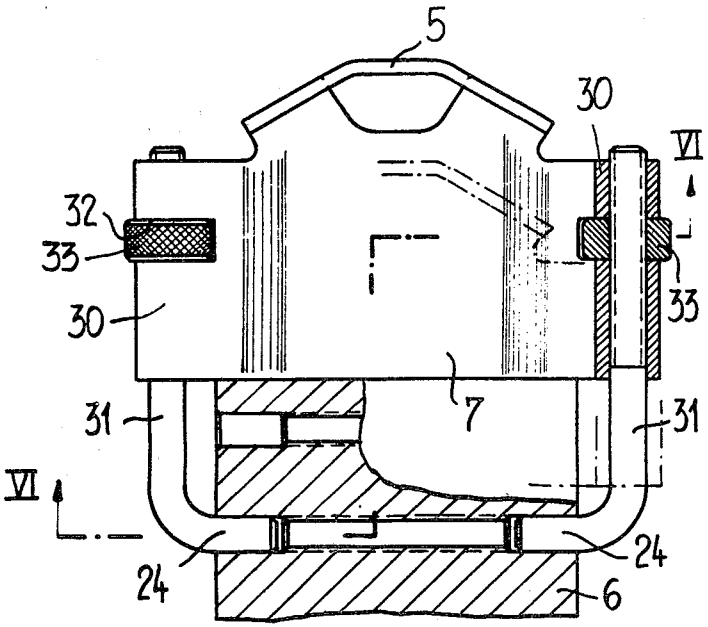
FIG. 5 is a top plan view of a further exemplary embodiment of the invention, wherein however the heel holddown and its actuation lever have been omitted for the purpose of clarity in illustration.
Figure 7:
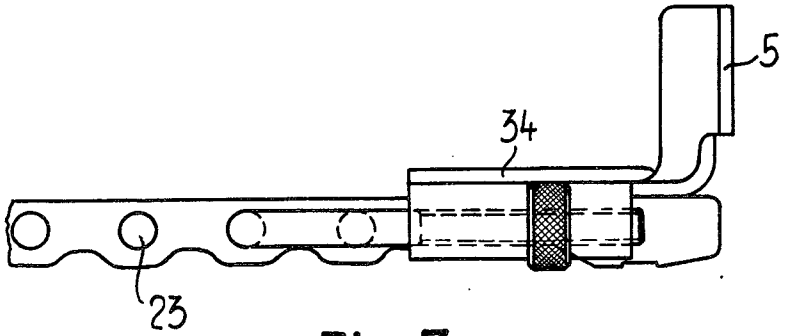
FIG. 7 is a side view of the arrangement of FIG. 5.

Now with the embodiment according to the showing of FIGS. 5–7, it will be seen that the flange 7 is provided at each side with an eyelet 30 into which engages in each case a threaded extension or projection 31 of the associated anchoring element, namely the anchoring pin 24. This threaded projection 31 extends in the lengthwise direction of the sole or release plate 6. Each eyelet 30 has a slot 32 receiving an associated knurled nut member 33 or equivalent structure, by means of which it is possible to carry out a fine adjustment of the flange 7 in the lengthwise direction of the plate. The coarse adjustment in this case is accomplished with the aid of the transverse bores or holes 23. Basically, it is not necessary to prevent pivoting or rocking of the flange 7 about the common axis of the anchoring pins 24, but appropriate measures could be provided, for instance, similar to the flaps 25 considered during the discussion of the previously described embodiment.

From the showing of FIG. 5 it will be seen that the web 5 is flexed or bent twice in order to provide a large surface area which engages behind the components 26, 3, 26 and, thus, provides a stable retention of the support or contact surface 27. To provide the desired rigidity the web 5 is connected at the region of its flexed end or terminal sections with the flange 7. In the embodiment of FIGS. 5–7, this flange 7 will be seen to have two ribs or protuberances 34 (FIGS. 6 and 7) extending in the lengthwise direction of the sole or release plate, and against which bears the heel 29 of the ski boot. Due to this construction snow sticking to the heel of the boot cannot impair proper contact between the ski boot and the sole or release plate. The same result has been obtained with the first discussed embodiment of FIGS. 1–4, by means of the attachment plates or rails 20, which, as best recognized by referring again to FIG. 3, form the actual heel support by means of their parts or portions 22 engaging over the flange 7.

The described heel holder—which incidentally can also be used as a sole holder, and therefore, this term is to be understood as being employed in its broader sense as encompassing at least these various possibilities—can be modified in a number of different ways. Thus, for instance, the components 26, 3, 26 forming the support or contact surface 27 can be separated from the guide or guide means 2 and directly connected with the flange 7, for instance in the manner of the web 5. In this case, the guide means 2 itself could be constructed to be elevationally displaceable. Also as concerns the construction of the actuation arrangement for the heel holddown 1 there are possible multi-farious modifications. In a simple constructional variation the heel holddown could be equipped with an eyelet through which there can be inserted the one end of the ski pole, and after bracing the tip of the ski pole on any part which is fixed to the ski, the heel holddown can be retracted out of the operation position into its ineffectual position by appropriately rocking the ski pole. It would be even conceivable to provide beneath such eyelet on a part fixed to the ski an inclined deflection or diverting surface, and for the purpose of retracting the heel holddown it would only be necessary to insert the end of the ski pole through the eyelet and to force it downwardly. It would be generally possible to provide a gap or space between the heel holddown and a part fixed to the ski, and the end of the ski pole which is inserted into such gap functions in the manner of a wedge which rearwardly shifts the heel holddown out of its operating or effectual position. Further, it would be also possible in a similar manner to use a wedge or a cam or similar structure, movably anchored for instance on the guide of the heel holddown, in order to rearwardly shift the heel holddown out of its operating or effectual position, and thus, if desired, also to block the same. The actuation and blocking of the heel holddown also could be accomplished by separate elements.

Although in the first instance it is important to provide a spring-loaded heel holddown which, owing to its inclined deflection surface, is rearwardly displaced when stepping into the binding and then automatically returns back into its operating or effectual position and which can be shifted back out of the operating position by means of an actuation mechanism, the illustrated embodiment will be recognized to be particularly advantageous by virtue of the fact that the components or parts which are effective in horizontal (i.e., laterally and in the lengthwise direction) and in the vertical direction can be assembled or combined into a structural unit.

The construction of the guide means 2 as a continuous channel, the provision of a bifurcated or fork-shaped actuation lever 17 and the arrangement of the latter between the cheeks or side plates of the guide means, counteracts the possible formation of ice on the heel- or sole holder or any contamination thereof.

Finally, it is here mentioned that the described embodiments of heel- or sole holder can of course be used on a binding for cross-country skiing or, however, also with a binding, the plate of which is fixedly mounted to the ski (such as encountered for instance with short and mini-skis and the like). The measures employed for the lengthwise- and elevational adjustment then could also be used in this case. In consideration of the foregoing possibilities of use of the heel- or sole holder, it is to be appreciated that the terms "sole plate" and "release plate", where appropriate, are interchangeably used and employed in their broader sense as covering both of the aforementioned possibilities.

While there are shown and described present preferred embodiments of the invention, it is to be distinctly understood that the invention is not limited thereto, but may be otherwise variously embodied and practiced within the scope of the following claims. Accordingly,

What I claim is:

1. A heel- or sole holder mounted on a sole or release plate of a ski binding, comprising:

guide means on the sole or release plate;

holddown means for locking the heel or sole of a boot on the sole or release plate independent of any automatic or safety release action of the ski binding;

means for movably guiding said holddown means in said guide means for movement downwardly and at an inclination in a direction towards a plane containing said plate;

said holddown means being inclinably movable between an operating position for holding down the heel or sole of a ski boot against a support surface of said plate for supporting a ski boot thereon and an ineffectual position;

a spring for biasing the holddown means into its operating position;

said holddown means being movable into its ineffectual position against the force of said spring;

said holddown means comprising a substantially wedge-shaped forward portion engaging the heel of the boot and being provided with a deflection surface which, in the operating position of the holddown means, is located over the ski boot-support surface of the plate and is directed in the direction of the spring force towards the plate;

said guide means sloping towards the plate in the direction of the line of action of the force of the spring.

2. The holder as defined in claim 1, further including:

means for blocking the holddown means in a retracted position corresponding to said ineffectual position.

3. The holder as defined in claim 1, further including:

means for rearwardly shifting said holddown means into its ineffectual position;

said rearwardly shifting means comprising a lever mechanism.

4. The holder as defined in claim 3, wherein:

said lever mechanism has an unstable equilibrium position with regard to the spring force.

5. The holder as defined in claim 3, wherein:

said lever mechanism includes an actuation lever;

said means for movably guiding said holddown means comprising means providing a first hinge structure which is stationary with respect to said plate;

said actuation lever being anchored to said first hinge structure;

means defining a second hinge structure;

said actuation lever being connected by means of said second hinge structure with said holddown means.

6. The holder as defined in claim 5, wherein:

each said hinge structure comprises a pivot pin.

7. The holder as defined in claim 5, wherein:

said spring for biasing said holddown means has a spring end which bears on said first hinge structure;

each hinge structure having a hinge axis;

said actuation lever being pivotable such that said axes of said hinge structures can be brought at least approximately into alignment with the line of action of the force of said spring.

8. The holder as defined in claim 7, wherein:

said holddown means is provided with a recess;

said spring being arranged in said recess.

9. The holder as defined in claim 8, wherein:

said second hinge structure comprises a movable hinge;

said holddown means including a guide slot inclined with respect to the direction of the line of action of the force of the spring;

said movable hinge structure being coupled by means of said guide slot with said holddown means.

10. The holder as defined in claim 9, wherein:

said actuation lever possesses a substantially bifurcated construction and laterally engages said holddown means at the region of said guide slot.

11. The holder as defined in claim 1, wherein:

said guide means encloses said holddown means laterally, from the top and from the bottom, in order to provide a substantially closed structure.

12. The holder as defined in claim 1, further including:

said sole or release plate being provided at its sides with transversely extending bores for anchoring the holder thereto;

anchoring pins for attaching said holddown means to said plate;

said anchoring pins engaging with said transversely extending bores and with said holddown means and being secured in axial direction therein.

13. The holder as defined in claim 12, further including:

adjustment means for connecting the holddown means with the anchoring pins;

said adjustment means permitting lengthwise adjustment of said holder on said plate.

14. The holder as defined in claim 13, wherein:

said adjustment means includes a flange connected to said holder to be lengthwise adjustable with respect to said plate for the fine adjustment of said holder;

said holddown means being supported on said plate by means of said flange.

15. The holder as defined in claim 14, wherein:

said flange has side portions provided with a fine tooth arrangement;

holder plates cooperating with the side portions of said flange;

said holder plates having complementary teeth coacting with said fine tooth arrangement of said flange;

said holder plates engaging over said flange and being connected by means of said anchoring pins with said plate.

16. The holder as defined in claim 14, wherein:

each of said anchoring pins includes a threaded projection extending substantially in the lengthwise direction of said plate;

said flange having opposite sides, each provided with an eyelet;

each said threaded projection extending into an associated one of said eyelets at the side of said flange; and a respective nut for supporting each such threaded projection at the corresponding side of said flange.

17. The holder as defined in claim 16, wherein:

each eyelet includes a transverse slot for receiving the associated nut.

18. The holder as defined in claim 12, further including:

adjustment means for elevationally adjusting said holder;

said adjustment means being arranged between said anchoring pins and said holddown means.

19. The holder as defined in claim 12, further including:

protuberance means arranged at least at the region of the plate intended to support the heel of the ski boot in order to reduce the support surface for the ski boot.

20. The holder as defined in claim 19, wherein:

said protuberance means comprises ribs.

21. The holder as defined in claim 1, wherein:

said holddown means has a transverse extent dimensioned to prevent lateral tilting of heel or sole when held by the holder.

22. The combination comprising:

a plate of a safety ski binding for supporting a ski boot thereon;

downwardly and forwardly inclined holddown means having a substantially wedge-shaped forward portion engaging the heel of the ski boot for urging the ski boot into contact with said plate independently of any automatic or safety release action of the safety ski binding;

said wedge-shaped forward portion being provided with a deflection surface which, in the operating position of the holddown means, is located over an upper edge of the heel of the boot;

means for mounting said holddown means for downward, inclined sliding movement in the direction of said plate;

said plate having at least one transversely extending bore; and anchoring means engaging with said transversely extending bore and with said holddown mounting means for connecting said holddown means with said plate.

23. The combination as defined in claim 22, wherein:

said anchoring means comprises anchoring pins.

24. The combination as defined in claim 23, wherein:

said plate is provided with a plurality of said transversely extending bores arranged lengthwise of said plate.

25. The combination as defined in claim 23, further including:

adjustment means for connecting the holddown means with the anchoring pins;

said adjustment means permitting lengthwise adjustment of said holddown means on said plate.

26. The combination as defined in claim 22, further including:

adjustment means for elevationally adjusting said holddown means.

27. The combination as defined in claim 22, further including:

protuberance means arranged at least at the region of the plate intended to support the heel of the ski boot in order to reduce the support surface for the ski boot.

28. The holder as defined in claim 29, wherein:

said protuberance means comprises ribs.

29. The combination comprising:

a plate of a safety ski binding for supporting a ski boot thereon;

downwardly and forwardly inclined holddown means having a substantially wedge-shaped forward portion engaging the heel of the ski boot for urging the ski boot into contact with said plate;

means for mounting said holddown means for downward, inclined sliding movement in the direction of said plate;

said plate having at least one transversely extending bore;

anchoring means engaging with said transversely extending bore and with said holddown mounting means for connecting said holddown means with said plate;

said anchoring means comprising anchoring pins;

adjustment means for connecting the holddown means with the anchoring pins;

said adjustment means permitting lengthwise adjustment of said holddown means on said plate;

said adjustment means including a flange connected to said holddown means to be lengthwise adjustable with respect to said plate for the fine adjustment of said holddown means; and said holddown means being supported on said plate by means of said flange.

30. The combination as defined in claim 29, wherein:

said flange has side portions provided with a fine tooth arrangement;

holder plates cooperating with the side portions of said flange;

said holder plates having complementary teeth coacting with said fine tooth arrangement of said flange;

said holder plates engaging over said flange and being connected by means of said anchoring pins with said plate.

31. The combination as defined in claim 29, wherein:

each of said anchoring pins includes a threaded projection extending substantially in the lengthwise direction of said plate;

said flange having opposite sides, each provided with an eyelet;

each said threaded projection extending into an associated one of said eyelets at the side of said flange; and a respective nut for supporting each such threaded projection at the corresponding side of said flange.

32. The combination as defined in claim 31, wherein:

each eyelet includes a transverse slot for receiving the associated nut.

* * * * *